US007035791B2

(12) United States Patent
Chazan et al.

(10) Patent No.: US 7,035,791 B2
(45) Date of Patent: Apr. 25, 2006

(54) FEATURE-DOMAIN CONCATENATIVE SPEECH SYNTHESIS

(75) Inventors: Dan Chazan, Haifa (IL); Ron Hoory, Haifa (IL)

(73) Assignee: International Business Machines Corporaiton, Armonk, NY (US)

( * ) Notice: Subject to any disclaimer, the term of this patent is extended or adjusted under 35 U.S.C. 154(b) by 790 days.

(21) Appl. No.: 09/901,031

(22) Filed: Jul. 10, 2001

(65) Prior Publication Data

US 2001/0056347 A1 Dec. 27, 2001

Related U.S. Application Data

(63) Continuation-in-part of application No. 09/432,081, filed on Nov. 2, 1999.

(51) Int. Cl.
*G10L 11/04* (2006.01)

(52) U.S. Cl. ..... 704/207; 704/205

(58) Field of Classification Search ..... 704/258, 704/260, 205, 206, 207, 208, 255, 267, 220, 704/266, 254, 214, 222, 203, 270.1; 395/2.76; 706/14

See application file for complete search history.

(56) References Cited

U.S. PATENT DOCUMENTS 4,896,359 A 1/1990 Yamamoto et al.
5,165,008 A 11/1992 Hermansky et al.
5,485,543 A * 1/1996 Aso ..... 704/267
5,528,516 A 6/1996 Yemini et al.
5,740,320 A 4/1998 Itoh
5,751,907 A 5/1998 Moebius et al.
5,774,855 A * 6/1998 Foti et al. ..... 704/267
5,913,193 A 6/1999 Huang et al.
5,940,795 A * 8/1999 Matsumoto ..... 704/258
6,041,300 A 3/2000 Ittycheriah et al.
6,076,083 A 6/2000 Baker
6,101,470 A * 8/2000 Eide et al. ..... 704/260
6,134,528 A * 10/2000 Miller et al. ..... 704/258
6,195,632 B1 * 2/2001 Pearson ..... 704/206
6,266,637 B1 * 7/2001 Donovan et al. ..... 704/258
6,334,106 B1 * 12/2001 Mizuno et al. ..... 704/260
6,366,883 B1 * 4/2002 Campbell et al. ..... 704/260
6,587,816 B1 7/2003 Chazan et al.
6,665,641 B1 * 12/2003 Coorman et al. ..... 704/260
6,697,780 B1 * 2/2004 Beutnagel et al. ..... 704/258
6,725,190 B1 4/2004 Chazan et al.

OTHER PUBLICATIONS

Yoshinori Sagisaka, Speech Synthesis by Rule Using an Optimal Selection of Non-Uniform Synthesis Units 1988, ATR Interpreting Telephony Research Laboratories, pp. 679-682.*

(Continued)

*Primary Examiner*—W. R. Young
*Assistant Examiner*—Jakieda Jackson
(74) *Attorney, Agent, or Firm*—Browdy and Neimark, PLLC

(57) ABSTRACT

A method for speech synthesis includes receiving an input speech signal containing a set of speech segments, and estimating spectral envelopes of the input speech signal in a succession of time intervals during each of the speech segments. The spectral envelopes are integrated over a plurality of window functions in a frequency domain so as to determine elements of feature vectors corresponding to the speech segments. An output speech signal is reconstructed by concatenating the feature vectors corresponding to a sequence of the speech segments.

72 Claims, 3 Drawing Sheets

OTHER PUBLICATIONS

Donovan et al., "The IBM Trainable Speech Synthesis System", *Proceedings of ICSLP*, (1998), 4 pages.
Rabiner et al., Fundamentals of Speech Recognition (Prentice-Hall), (1993), pp. 125-128.
Davis et al., "Comparison of Parametric Representations for Monosyllabic Word Recognition in Continuously Spoken Sentences", *IEEE Transactions on Acoustics, Speech, and Signal Processing*, (1980), vol. ASSP-28, No. 4, pp. 357-366.
Syrdal et al., "TD-PSOLA Versus Harmonic Plus Noise Model in Diphone Based Speech Synthesis", *Proceedings of ICASSP*, (1998), 4 pages.
Huang et al., "Recent Improvements on Microsoft's Trainable Text-to-Speech Systems-Whistler", *Proceedings of ICASSP*, (1998), 4 pages.
Chazan et al., "Speech Reconstruction from Mel Frequency Cepstral Coefficients and Pitch Frequency", *Proceedings of the International Conference On Acoustics Speech and Signal Processing*, (2000), 4 pages.
Hess, "Pitch Determination of Speech Signals", Printer-Verlag, (1983).
Ramaswamy et al., "Compression of Acoustic Features for Speech Recognition in Network Environments", *Proceedings of ICASSP*, (1998).
Hoory et al., "Speech Synthesis for a Specific Speaker Based on a Labeled Speech Database", *Proceedings of the International Conference on Pattern Recognition*, (1994), pp. C145-C148.
Donovan, "Segment Pre-Selection in Decision-Tree Based Speech Synthesis Systems", *ICASSP*, (2000), 4 pages.

* cited by examiner

FEATURE-DOMAIN CONCATENATIVE SPEECH SYNTHESIS

CROSS-REFERENCE TO RELATED APPLICATION

This application is a continuation-in-part of U.S. patent application Ser. No. 09/432,081, filed Nov. 02, 1999 which is assigned to the assignee of the present patent application and whose disclosure is incorporated herein by reference.

FIELD OF THE INVENTION

The present invention relates generally to computerized speech synthesis, and specifically to methods and systems for efficient, high-quality text-to-speech conversion.

BACKGROUND OF THE INVENTION

Effective text-to-speech (TTS) conversion requires not only that the acoustic TTS output be phonetically correct, but also that it faithfully reproduce the sound and prosody of human speech. When the range of phrases and sentences to be reproduced is fixed, and the TTS converter has sufficient memory resources, it is possible simply to record a collection of all of the phrases and sentences that will be used, and to recall them as required. This approach is not practical, however, when the text input is arbitrarily variable, or when speech is to be synthesized by a device having only limited memory resources, such as an embedded speech synthesizer in a handheld computing or communication device, for example.

TTS systems for synthesis of arbitrary speech typically perform three essential functions:

1. Division of text into synthesis units, or segments, such as phonemes or other subdivisions.
2. Determination of prosodic parameters, such as segment duration, pitch and energy.
3. Conversion of the synthesis units and prosodic parameters into a speech stream.

A useful survey of these functions and of different approaches to their implementation is presented by Robert Edward Donovan in *Trainable Speech Synthesis* (Ph.D. dissertation, University of Cambridge, 1996), which is incorporated herein by reference. The present invention is concerned primarily with the third function, i.e., generation of a natural, intelligible speech stream from a sequence of phonetic and prosodic parameters.

In order to synthesize high-quality speech from an arbitrary text input, a large database is created, containing speech segments in a variety of different phonetic contexts. For any given text input, the synthesizer then selects the optimal segments from the database. Typically, the selection is based on a feature representation of the speech, such as mel-frequency cepstral coefficients (MFCCs). These coefficients are computed by integration of the spectrum of the recorded speech segments over triangular bins on a mel-frequency axis, followed by log and discrete cosine transform operations. Computation of MFCCs is described, for example, by Davis et al. in "Comparison of Parametric Representations for Monosyllabic Word Recognition in Continuously Spoken Sentences," *IEEE Transactions on Acoustics, Speech and Signal Processing* ASSP-28 (1980), pp. 357–366, which is incorporated herein by reference. Other types of feature representations are also known in the art.

In order to dynamically choose the optimal segments from the database in real time, the synthesizer applies a cost function to the feature vectors of the speech segments, based on a measure of vector distance. The synthesizer then concatenates the selected segments, while adjusting their prosody and pitch to provide a smooth, natural speech output. Typically, Pitch Synchronous Overlap and Add (PSOLA) algorithms are used for this purpose, such as the Time Domain PSOLA (TD-PSOLA) algorithm described in the above-mentioned thesis by Donovan. This algorithm breaks speech segments into many short-term (ST) signals by Hanning windowing. The ST signals are altered to adjust their pitch and duration, and are then recombined using an overlap-add scheme to generate the speech output.

Although PSOLA schemes give generally good speech quality, it requires a large database of carefully-chosen speech segments. One of the reasons for this requirement is that PSOLA is very sensitive to prosody changes, especially pitch modification. Therefore, in order to minimize the prosody modifications at synthesis time, the database must contain segments with a large variety of pitch and duration values. Other problems with PSOLA schemes include:

- Frequent mismatch between the selection process, which is based on spectral features extracted from the speech, and the concatenation process, which is applied to the ST signals. The result is audible discontinuities in the synthesized signal (typically resulting from phase mismatches).
- High computational complexity of the segment selection process, caused by a complex cost function usually introduced to overcome the limitations mentioned above.
- Large additional overhead to the speech data in the database (for example, pitch marking and features for segment selection) and a complex database generation (training) process. There is therefore a need for a speech synthesis technique that can provide high-quality speech output without the large memory requirements and computational cost that are associated with PSOLA and other concatenative methods known in the art.

Various methods of concatenative speech synthesis are described in the patent literature. For example, U.S. Pat. No. 4,896,359, to Yamamoto et al., whose disclosure is incorporated herein by reference, describes a speech synthesizer that operates by actuating a voice source and a filter, which processes the voice source output based on a succession of short-interval feature vectors. U.S. Pat. No. 5,165,008, to Hermansky et al., whose disclosure is likewise incorporated herein by reference, describes a method for speech synthesis using perceptual linear prediction parameters, based on a speaker-independent set of cepstral coefficients. U.S. Pat. No. 5,740,320, to Itoh, whose disclosure is also incorporated herein by reference, describes a method of text-to-speech synthesis by concatenation of representative phoneme waveforms selected from a memory. The representative waveforms are chosen by clustering phoneme waveforms recorded in natural speech, and selecting the waveform closest to the centroid of each cluster as the representative waveform for the cluster.

Similarly, U.S. Pat. No. 5,751,907, to Moebius et al., whose disclosure is incorporated herein by reference, describes a speech synthesizer having an acoustic element database that is established from phonetic sequences occurring in an interval of natural speech. The sequences are chosen so that perceptible discontinuities at junction phonemes between acoustic elements are minimized in the synthesized speech. U.S. Pat. No. 5,913,193, to Huang et al., whose disclosure is also incorporated herein by reference, describes a concatenative speech synthesis system that stores multiple instances of each acoustic unit during a training phase. The synthesizer chooses the instance that most closely resembles a desired instance, so that the need to alter the stored instance is reduced, while also reducing spectral distortion between the boundaries of adjacent instances.

U.S. Pat. No. 6,041,300, to Ittycheriah et al., whose disclosure is incorporated herein by reference, describes a speech recognition system that synthesizes and replays words that are spoken into the system so that the speaker can confirm that the word is correct. The system uses a waveform database, from which appropriate waveforms are selected, followed by acoustic adjustment and concatenation of the waveforms. For the purpose of speech recognition, the component phonemes in the spoken words are divided into sub-units, known as lefemes, which are the beginning, middle and ending portions of the phoneme. The lefemes are modeled and analyzed using Hidden Markov Models (HMMs). HMM-modeling of lefemes can also be used in speech synthesis, as described in the above-mentioned U.S. Pat. No. 5,913,193 and in Donovan's thesis.

SUMMARY OF THE INVENTION

The above-mentioned U.S. patent application Ser. No. 09/432,081 describes an improved method for synthesizing speech based on spectral reconstruction of the speech from feature vectors, such as vectors of MFCCs or other cepstral parameters. In accordance with this method, a complex line spectrum of the output signal is computed as a non-negative linear combination of basis functions, derived from the feature vector elements. (In the context of the present patent application and in the claims, the term "complex line spectrum" refers to the sequence of respective sine-wave amplitudes, phases and frequencies in a sinusoidal speech representation.) The sequences of feature vectors corresponding to successive speech output segments are concatenated in the feature domain, rather than in the time domain as in TD-PSOLA and related techniques known in the art. Only after concatenation and spectral reconstruction is the spectrum converted to the time domain (preferably by short-term inverse Discrete Fourier Transform) for output as a speech signal. This method is further described by Chazan et al. in "Speech Reconstruction from Mel Frequency Cepstral Coefficients and Pitch Frequency," *Proceedings of the International Conference on Acoustics, Speech and Signal Processing* (*ICASSP*), June, 2000, which is incorporated herein by reference.

Preferred embodiments of the present invention provide methods and devices for speech synthesis, based on storing feature vectors corresponding to speech segments, and then synthesizing speech by selecting and concatenating the feature vectors. These methods are useful particularly in the context of feature-domain speech synthesis, as described in the above-mentioned U.S. patent application and in the article by Chazan et al. They enable high-quality speech to be synthesized from a text input, while using a much smaller database of speech segments than is required by speech synthesis systems known in the art.

In preferred embodiments of the present invention, the segment database is constructed by recording natural speech, partitioning the speech into phonetic units, preferably lefemes, and analyzing each unit to determine corresponding segment data. Preferably, these data comprise, for each segment, a corresponding sequence of feature vectors, a segment lefeme index, and segment duration, energy and pitch values. Most preferably, the feature vectors comprise spectral coefficients, such as MFCCs, along with voicing information, and are compressed to reduce the volume of data in the database.

To synthesize speech from text, a TTS front end analyzes the input text to generate phoneme labels and prosodic parameters. The phonemes are preferably converted into lefemes, represented by corresponding HMMs, as is known in the art. A segment selection unit chooses a series of segments from the database corresponding to the series of lefemes and their prosodic parameters by computing and minimizing a cost function over the candidate segments in the database. Preferably, the cost function depends both on a distance between the required segment parameters and the candidate parameters and on a distance between successive segments in the series, based on their corresponding feature vectors. The selected segments are adjusted based on the prosodic parameters, preferably by modifying the sequences of feature vectors to accord with the required duration and energy of the segments. The adjusted sequences of feature vectors for the successive segments are then concatenated to generate a combined sequence, which is processed to reconstruct the output speech, preferably as described in the above-mentioned U.S. patent application.

There is therefore provided, in accordance with a preferred embodiment of the present invention, a method for speech synthesis, including:

providing a segment inventory including, for a plurality of speech segments, respective sequences of feature vectors, by estimating spectral envelopes of input speech signals corresponding to the speech segments in a succession of time intervals during each of the speech segments, and integrating the spectral envelopes over a plurality of window functions in a frequency domain so as to determine vector elements of the feature vectors;

receiving phonetic and prosodic information indicative of an output speech signal to be generated;

selecting the sequences of feature vectors from the inventory responsive to the phonetic and prosodic information;

processing the selected sequences of feature vectors so as to generate a concatenated output series of feature vectors;

computing a series of complex line spectra of the output signal from the series of the feature vectors; and transforming the complex line spectra to a time domain speech signal for output.

Preferably, providing the segment inventory includes providing segment information including respective phonetic identifiers of the segments, and selecting the sequences of feature vectors includes finding the segments whose phonetic identifiers are close to the received phonetic information. Most preferably, the segments include lefemes, and the phonetic identifiers include lefeme labels. Additionally or alternatively, the segment information further includes one or more prosodic parameters with respect to each of the segments, and selecting the sequences of feature vectors includes finding the segments whose one or more prosodic parameters are close to the received prosodic information. Preferably, the one or more prosodic parameters are selected from a group of parameters consisting of a duration, an energy level and a pitch of each of the segments.

In a preferred embodiment, the feature vectors include auxiliary vector elements indicative of further features of the speech segments, in addition to the elements determined by integrating the spectral envelopes of the input speech signals. Preferably, the auxiliary vector elements include voicing vector elements indicative of a degree of voicing of frames of the corresponding speech segments, and computing the complex line spectra includes reconstructing the output speech signal with the degree of voicing indicated by the voicing vector elements. Further preferably, receiving the prosodic information includes receiving pitch values, and reconstructing the output speech signal includes adjusting a frequency spectrum of the output speech signal responsive to the pitch values.

Preferably, selecting the sequences of feature vectors includes selecting candidate segments from the inventory, computing a cost function for each of the candidate segments responsive to the phonetic and prosodic information and to the feature vectors of the candidate segments, and selecting the segments so as to minimize the cost function.

Further preferably, concatenating the selected sequences of feature vectors includes adjusting the feature vectors responsive to the prosodic information. Most preferably, the prosodic information includes respective durations of the segments to be incorporated in the output speech signal, and adjusting the feature vectors includes removing one or more of the feature vectors from the selected sequences so as to shorten the durations of one or more of the segments, or adding one or more further feature vectors to the selected sequences so as to lengthen the durations of one or more of the segments. Additionally or alternatively, the prosodic information includes respective energy levels of the segments to be incorporated in the output speech signal, and adjusting the feature vectors includes altering one or more of the vector elements so as to adjust the energy levels of one or more of the segments.

Preferably, processing the selected sequences includes adjusting the vector elements so as to provide a smooth transition between the segments in the time domain signal.

There is also provided, in accordance with a preferred embodiment of the present invention, a method for speech synthesis, including:

receiving an input speech signal containing a set of speech segments;

estimating spectral envelopes of the input speech signal in a succession of time intervals during each of the speech segments;

integrating the spectral envelopes over a plurality of window functions in a frequency domain so as to determine elements of feature vectors corresponding to the speech segments; and reconstructing an output speech signal by concatenating the feature vectors corresponding to a sequence of the speech segments.

Preferably, receiving the input speech signal includes dividing the input speech signal into the segments and determining segment information including respective phonetic identifiers of the segments, and reconstructing the output speech signal includes selecting the segments whose feature vectors are to be concatenated responsive to the segment information determined with respect to the segments. Most preferably, dividing the input speech signal into the segments includes dividing the signal into lefemes, and wherein the phonetic identifiers include lefeme labels. Additionally or alternatively, determining the segment information further includes finding respective segment parameters including one or more of a duration, an energy level and a pitch of each of the segments, responsive to which parameters the segments are selected for use in reconstructing the output speech signal, and reconstructing the output speech signal includes modifying the feature vectors of the selected segments so as to adjust the segment parameters of the segments in the output speech signal.

Preferably, the window functions are non-zero only within different, respective spectral windows and have variable values over their respective windows, and integrating the spectral envelopes includes calculating products of the spectral envelopes with the window functions, and calculating integrals of the products over the respective windows of the window functions. Further preferably, the method includes applying a mathematical transformation to the integrals in order to determine the elements of the feature vectors. Most preferably, the frequency domain includes a Mel frequency domain, and applying the mathematical transformation includes applying log and discrete cosine transform operations in order to determine Mel Frequency Cepstral Coefficients to be used as the elements of the feature vectors.

There is additionally provided, in accordance with a preferred embodiment of the present invention, a device for speech synthesis, including:

a memory, arranged to hold a segment inventory including, for a plurality of speech segments, respective sequences of feature vectors having vector elements determined by estimating spectral envelopes of input speech signals corresponding to the speech segments in a succession of time intervals during each of the speech segments, and integrating the spectral envelopes over a plurality of window functions in a frequency domain; and a speech processor, arranged to receive phonetic and prosodic information indicative of an output speech signal to be generated, to select the sequences of feature vectors from the inventory responsive to the phonetic and prosodic information, to process the selected sequences of feature vectors so as to generate a concatenated output series of feature vectors, and to compute a series of complex line spectra of the output signal from the series of the feature vectors and transform the complex line spectra to a time domain speech signal for output.

There is further provided, in accordance with a preferred embodiment of the present invention, a device for speech synthesis, including:

a memory, arranged to hold a segment inventory determined by processing an input speech signal containing a set of speech segments so as to estimate spectral envelopes of the input speech signal in a succession of time intervals during each of the speech segments, and integrating the spectral envelopes over a plurality of window functions in a frequency domain so as to determine elements of feature vectors corresponding to the speech segments; and a speech processor, arranged to reconstruct an output speech signal by concatenating the feature vectors corresponding to a sequence of the speech segments.

There is moreover provided, in accordance with a preferred embodiment of the present invention, a computer software product, including a computer-readable medium in which program instructions are stored, which instructions, when read by a computer, cause the computer to access a segment inventory including, for a plurality of speech segments, respective sequences of feature vectors having vector elements determined by estimating spectral envelopes of input speech signals corresponding to the speech segments in a succession of time intervals during each of the speech segments, and integrating the spectral envelopes over a plurality of window functions in a frequency domain, and in response to phonetic and prosodic information indicative of an output speech signal to be generated, cause the computer to select the sequences of feature vectors from the inventory responsive to the phonetic and prosodic information, to process the selected sequences of feature vectors so as to generate a concatenated output series of feature vectors, and to compute a series of complex line spectra of the output signal from the series of the feature vectors and transform the complex line spectra to a time domain speech signal for output.

There is furthermore provided, in accordance with a preferred embodiment of the present invention, a computer software product, including a computer-readable medium in which a segment inventory is stored, the inventory having been determined by processing an input speech signal containing a set of speech segments so as to estimate spectral envelopes of the input speech signal in a succession of time intervals during each of the speech segments, and integrating the spectral envelopes over a plurality of window functions in a frequency domain so as to determine elements of feature vectors corresponding to the speech segments, so that a speech processor can reconstruct an output speech signal by concatenating the feature vectors corresponding to a sequence of the speech segments.

The present invention will be more fully understood from the following detailed description of the preferred embodiments thereof, taken together with the drawings in which:

DETAILED DESCRIPTION OF PREFERRED EMBODIMENTS

Figure 1:
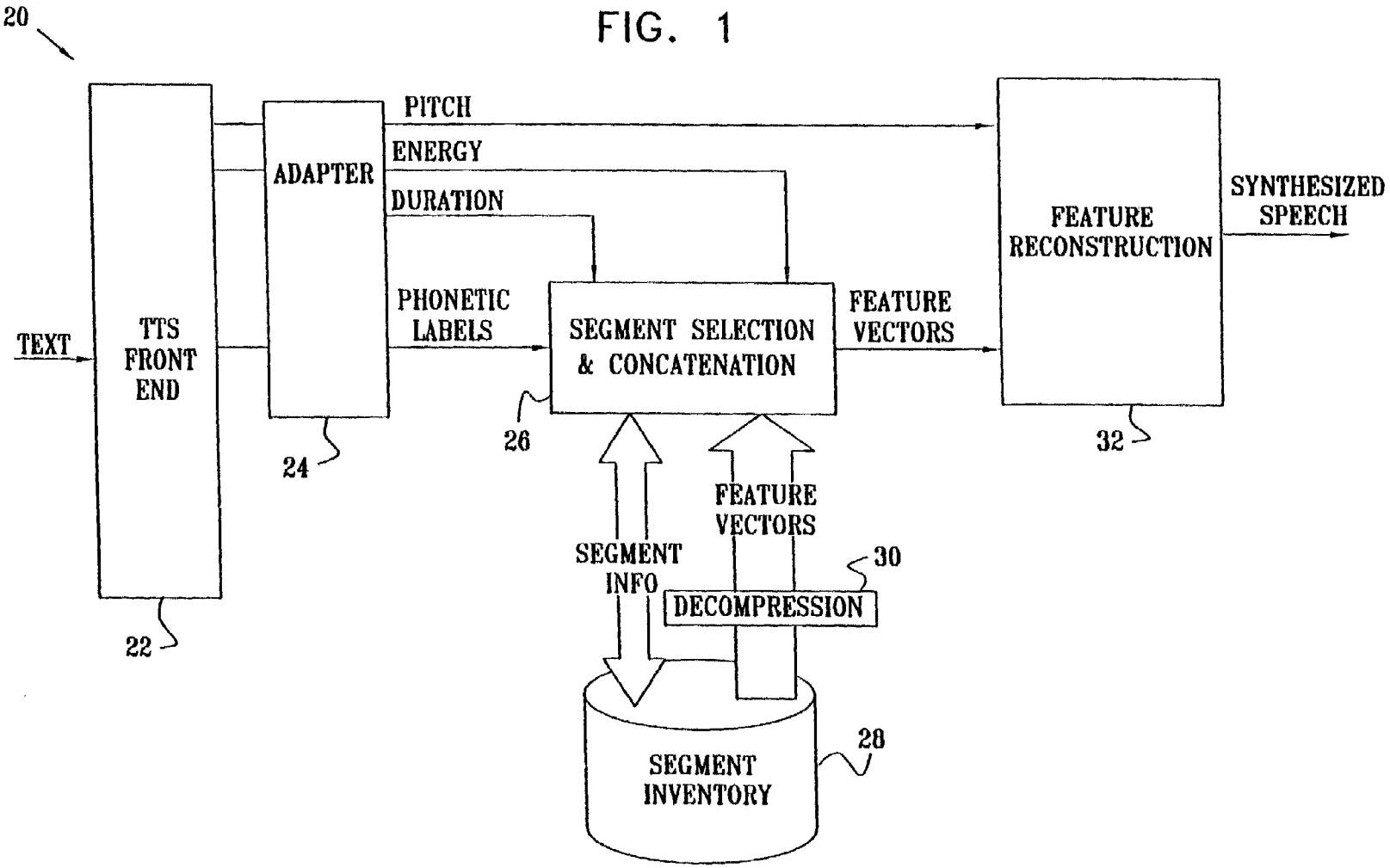
FIG. 1 is a block diagram that schematically illustrates a device for synthesis of speech signals, in accordance with a preferred embodiment of the present invention.

FIG. 1 is a block diagram that schematically illustrates a speech synthesis device 20, in accordance with a preferred embodiment of the present invention. Device 20 typically comprises a general-purpose or embedded computer processor, which is programmed with suitable software for carrying out the functions described hereinbelow. Thus, although device 20 is shown in FIG. 1 as comprising a number of separate functional blocks, these blocks are not necessarily separate physical entities, but rather represent different computing tasks. These tasks may be carried out in software running on a single processor, or on multiple processors. The software may be provided to the processor or processors in electronic form, for example, over a network, or it may be furnished on tangible media, such as CD-ROM or non-volatile memory. Alternatively or additionally, device 20 may comprise a digital signal processor (DSP) or hard-wired logic.

Device 20 typically receives its input in the form of a stream of text characters. A TTS front end 22 of the processor analyzes the text to generate phoneme labels and prosodic information, as is known in the art. The prosodic information preferably comprises pitch, energy and duration associated with each of the phonemes. An adapter 24 converts the phonetic labels and prosodic information into a form required by a segment selection and concatenation block 26. Although front end 22 and adapter 24 are shown for the sake of clarity as separate functional units, the functions of these two units may easily be combined.

Preferably, for each phoneme, adapter 24 generates three lefeme labels, each comprising a HMM, as is known in the art. The duration and energy of each phoneme are likewise converted into a series of three lefeme durations and lefeme energies. This conversion can be carried out using simple interpolation methods or, alternatively, by following a decision tree from its roots down to the leaves associated with the appropriate HMMs. The decision tree method is described by Donovan in the above-mentioned thesis. Adapter 24 preferably interpolates the pitch values output by front end 22, most preferably so that there is a pitch value for every 10 ms frame of output speech.

Segment selection and concatenation block 26 receives the lefeme labels and prosodic parameters generated by adapter 24, and uses these data to produce a series of feature vectors for output to a feature reconstructor 32. Block 26 generates the series of feature vectors based on feature data extracted from a segment inventory 28 held in a memory associated with device 20. Inventory 28 contains a database of speech segments, along with a corresponding sequence of feature vectors for each segment. The inventory is preferably produced using methods described hereinbelow with reference to FIG. 3. Each speech segment in the inventory is identified by segment information, including a corresponding lefeme label, duration and energy. The feature vectors comprise spectral coefficients, most preferably MFCCs, along with a voicing parameter, indicating whether the corresponding speech frame is voiced or unvoiced. The above-mentioned U.S. patent application Ser. No. 09/432,081 gives a detailed specification of a preferred structure and method of computation of such feature vectors. Preferably, the feature vectors are held in the memory in compressed form, and are decompressed by a decompression unit 30 when required by block 26. Further details of the operation of block 26 are described hereinbelow with reference to FIG. 2.

Feature reconstructor 32 processes the series of feature vectors that are output by block 26, together with the associated pitch information from adapter 24, so as to generate a synthesized speech signal in digital form. Reconstructor 32 preferably operates in accordance with the method described in the above-mentioned U.S. patent application Ser. No. 09/432,081. Further aspects of this method are described in the above-mentioned article by Chazan et al., as well as in U.S. patent application Ser. No. 09/410,085, which is assigned to the assignee of the present patent application, and whose disclosure is incorporated herein by reference.

Figure 2:
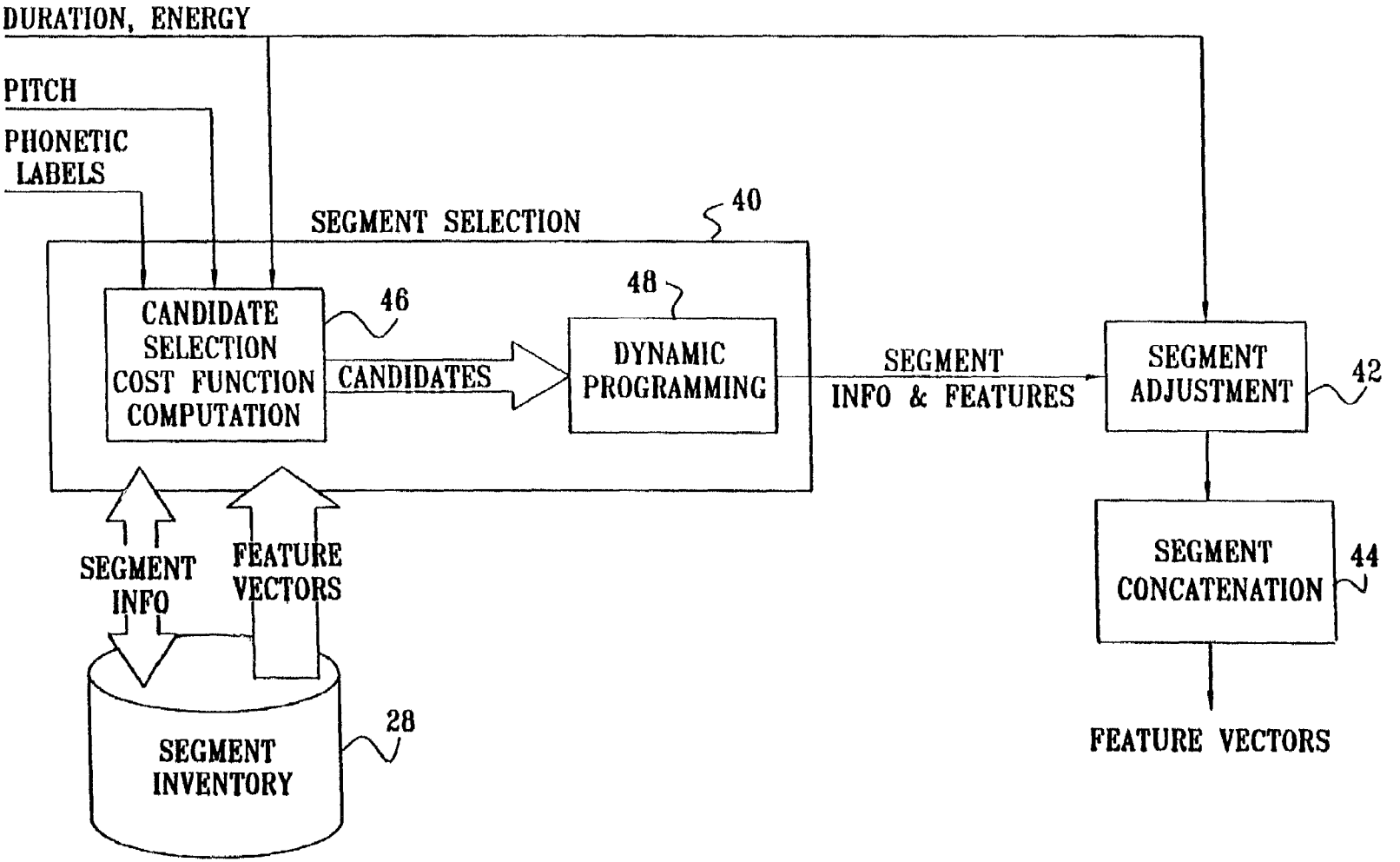
FIG. 2 is a block diagram that schematically shows details of the device of FIG. 1, in accordance with a preferred embodiment of the present invention.

FIG. 2 is a block diagram that schematically shows details of segment selection and concatenation block 26, in accordance with a preferred embodiment of the present invention. A segment selector 40 in block 26 is responsible for selecting the segments from inventory 28 that correspond to the segment information received from adapter 24. As a first stage in this process, a candidate selection block 46 finds the segments in the inventory whose segment parameters (lefeme label, duration, energy and pitch) are closest to the parameters specified by adapter 24. Typically, a distance between the specified parameters and the parameters of the candidate segments in inventory 28 is determined as a weighted sum of the differences of the corresponding parameters. Certain parameters, such as pitch, may have little or no weight in this sum. The segments in inventory 28 whose respective distances from the specified parameter set are smallest are chosen as candidates.

For each candidate segment, block 46 determines a cost function. The cost function is based on the distance between the specified parameters and the segment parameters, as described above, and on a distance between the current segment and the preceding segment in the series chosen by selector 40. This distance between successive segments in the series is computed based on the respective feature vectors of the segments. A dynamic programming unit 48 uses the cost function values to select the series of segments that minimizes the cost function. Methods for cost function computation and dynamic programming of this sort are known in the art. Exemplary methods are described by Donovan in the above-mentioned thesis and by Huang et al. in U.S. Pat. No. 5,913,193, as well as by Hoory et al., in "Speech Synthesis for a Specific Speaker Based on a Labeled Speech Database," *Proceedings of the International Conference on Pattern Recognition* (1994), pp. C145–148, which is incorporated herein by reference.

The segments chosen by selector 40, along with their corresponding sequences of feature vectors and other segment parameters, are passed to a segment adjuster 42. Adjuster 42 alters the segment parameters that were read from inventory 28 so that they match the prosodic information received from adapter 24. Preferably, the duration and energy adjustment is carried out by modifying the feature vectors. For example, for each 10 ms by which the duration of a segment needs to be shortened, one feature vector is removed from the series. Alternatively, feature vectors may be duplicated or interpolated as necessary to lengthen the segment. As a further example, the energy of the segment may be altered by increasing or decreasing the lowest-order mel-cepstral coefficient for the MFCC feature vectors. The adjusted feature vectors are input to a segment concatenator 44, which generates the combined series of feature vectors that is output to reconstructor 32.

Figure 3:
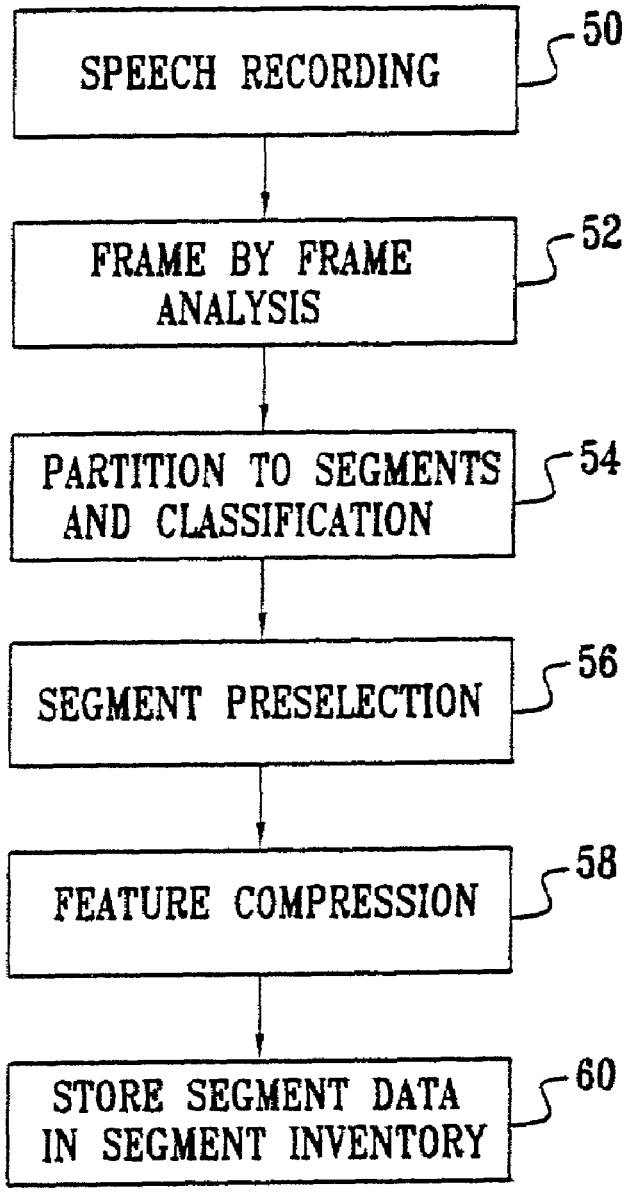
FIG. 3 is a flow chart that schematically illustrates a method for generating a speech segment inventory, in accordance with a preferred embodiment of the present invention.

FIG. 3 is a flow chart that schematically illustrates a method for generating segment inventory 28, in accordance with a preferred embodiment of the present invention. To begin, a recording is made of the speaker whose voice is to be synthesized, at a recording step 50. Preferably, the speaker reads a list of sentences, which have been prepared in advance. The speech is digitized and divided into frames, each preferably of 10 ms duration, at a frame analysis step 52. For each frame, a feature vector is computed, by estimating the spectral envelope of the signal; multiplying the estimate by a set of frequency-domain window functions; and integrating the product of the multiplication over each of the windows. The elements of the feature vector are given either by the integrals themselves or, preferably, by a set of predetermined functions applied to the integrals. Most preferably the vector elements are MFCCs, as described, for example, in the above-mentioned article by Davis et al. and in U.S. patent application Ser. No. 09/432,081.

The analysis at step 52 also estimates the pitch of the frame and thus determines whether the frame is voiced or unvoiced. A preferred method of pitch estimation is described in U.S. patent application Ser. No. 09/617,582, filed Jul. 14, 2000, which is assigned to the assignee of the present patent application and is incorporated herein by reference. The voicing parameter, indicating whether the frame is voiced or unvoiced, is then added to the feature vector. Alternatively, the voicing parameter may indicate a degree of voicing, with a continuous value between 0 (purely unvoiced) and 1 (purely voiced). Further analysis may be carried out, and additional auxiliary information may be added to the feature vector in order to enhance the synthesized speech quality.

The digitized speech is further analyzed to partition it into segments, at a segmentation step 54. Each segment is classified, preferably using HMMs, as described by Donovan in the above-mentioned thesis, and in U.S. Pat. Nos. 5,913,193 and 6,041,300. This classification yields segment parameters including a lefeme label (or lefeme index), energy level, duration, segment pitch and segment location in the database. The energy level and pitch are computed based on the parameters of the frames in the present segment, which were determined at step 52. Optionally, statistical analysis training of statistical models on the available recordings is performed first, in order to improve the classification. Typically, such training involves retraining the HMM models and the decision trees using the database samples, so that they are adapted to the specific speaker and database contents. Prior to such retraining, it is assumed that a general, speaker-independent model is used for classification. A training procedure of this sort is described by Donovan in the above-mentioned thesis.

Preferably, in order to limit the size of inventory 28, some of the segments and their corresponding feature vectors are discarded, at a preselection step 56. A suitable method for such preselection is described by Donovan in an article entitled "Segment Pre-selection in Decision-Tree Based Speech Synthesis Systems," *Proceedings of the International Conference on Acoustics, Speech and Signal Processing* (*ICASSP*), June, 2000, which is incorporated herein by reference. To reduce the size of the inventory still further, the feature vectors are preferably compressed, at a compression step 58. An exemplary compression scheme is illustrated in Table I, below. This scheme operates on a 24-dimensional MFCC feature vector by grouping the vector elements into sub-vectors, and then quantizing each sub-vector using a separate codebook. Preferably, for maximal coding efficiency, the codebook is generated by training on the actual feature vector data that are to be included in inventory 28, using training methods known in the art. One training method that may be used for this purpose is K-means clustering, as described by Rabiner et al., in *Fundamentals of Speech Recognition* (Prentice-Hall, 1993), pages 125–128, which is incorporated herein by reference. The codebook is then used by decompression unit 30 is decompressing the feature vectors as they are recalled from the inventory by block 26.

TABLE I

FEATURE VECTOR COMPRESSION

| Component index | Number of bits | Codebook size |
|---|---|---|
| 0 | 5 | 32 |
| 1–2 | 9 | 512 |
| 3–5 | 10 | 1024 |
| 6–8 | 9 | 512 |
| 9–12 | 9 | 512 |
| 13–17 | 8 | 256 |
| 18–23 | 6 | 64 |

As noted above, the compression scheme shown in Table I above relates to the MFCC elements of the feature vector. Other elements of the vector, such as the voicing parameter and other auxiliary data, are preferably compressed separately from the MFCCS, typically by scalar or vector quantization.

The data for each of the segments selected at step 56 are stored in inventory 28, at a storage step 60. As noted above, these data preferably include the segment lefeme index, the segment duration, energy and pitch values, and the compressed series of feature vectors (including MFCCS, voicing information and possibly other auxiliary information) for the series of 10 ms frames that make up the segment.

Although embodiments described herein make use of certain preferred methods of spectral representation (such as MFCCS) and phonetic analysis (such as lefemes and HMMS), it will be appreciated that the principles of the present invention may similarly be applied using other such methods, as are known in the art of speech analysis and synthesis. Furthermore, although these embodiments are described in the context of TTS conversion, the principles of the present invention can also be used in other speech synthesis applications that are not text-based.

It will thus be understood that the preferred embodiments described above are cited by way of example, and that the present invention is not limited to what has been particularly shown and described hereinabove. Rather, the scope of the present invention includes both combinations and subcombinations of the various features described hereinabove, as well as variations and modifications thereof which would occur to persons skilled in the art upon reading the foregoing description and which are not disclosed in the prior art.

The invention claimed is:

1. A method for speech synthesis, comprising:

providing a segment inventory comprising, for a plurality of speech segments, respective sequences of feature vectors, by estimating spectral envelopes of input speech signals corresponding to the speech segments in a succession of time intervals during each of the speech segments, and integrating the spectral envelopes over a plurality of window functions in a frequency domain so as to determine vector elements of the feature vectors;

receiving phonetic and prosodic information indicative of an output speech signal to be generated;

selecting the sequences of feature vectors from the inventory responsive to the phonetic and prosodic information;

processing the selected sequences of feature vectors so as to generate a concatenated output series of feature vectors in a frequency domain;

computing a series of complex line spectra of the output signal from the series of the feature vectors; and transforming the complex line spectra to a time domain speech signal for output.

2. A method according to claim 1, wherein providing the segment inventory comprises providing segment information comprising respective phonetic identifiers of the segments, and wherein selecting the sequences of feature vectors comprises finding the segments whose phonetic identifiers are close to the received phonetic information.

3. A method according to claim 2, wherein the segments comprise lefemes, and wherein the phonetic identifiers comprise lefeme labels.

4. A method according to claim 2, wherein the segment information further comprises one or more prosodic parameters with respect to each of the segments, and wherein selecting the sequences of feature vectors comprises finding the segments whose one or more prosodic parameters are close to the received prosodic information.

5. A method according to claim 4, wherein the one or more prosodic parameters are selected from a group of parameters consisting of a duration, an energy level and a pitch of each of the segments.

6. A method according to claim 1, wherein the feature vectors comprise auxiliary vector elements indicative of further features of the speech segments, in addition to the elements determined by integrating the spectral envelopes of the input speech signals.

7. A method according to claim 6, wherein the auxiliary vector elements comprise voicing vector elements indicative of a degree of voicing of frames of the corresponding speech segments, and wherein computing the complex line spectra comprises reconstructing the output speech signal with the degree of voicing indicated by the voicing vector elements.

8. A method according to claim 7, wherein receiving the prosodic information comprises receiving pitch values, and wherein reconstructing the output speech signal comprises adjusting a frequency spectrum of the output speech signal responsive to the pitch values.

9. A method according to claim 1, wherein selecting the sequences of feature vectors comprises:

selecting candidate segments from the inventory;

computing a cost function for each of the candidate segments responsive to the phonetic and prosodic information and to the feature vectors of the candidate segments; and selecting the segments so as to minimize the cost function.

10. A method according to claim 1, wherein concatenating the selected sequences of feature vectors comprises adjusting the feature vectors responsive to the prosodic information.

11. A method according to claim 10, wherein the prosodic information comprises respective durations of the segments to be incorporated in the output speech signal, and wherein adjusting the feature vectors comprises removing one or more of the feature vectors from the selected sequences so as to shorten the durations of one or more of the segments.

12. A method according to claim 10, wherein the prosodic information comprises respective durations of the segments to be incorporated in the output speech signal, and wherein adjusting the feature vectors comprises adding one or more further feature vectors to the selected sequences so as to lengthen the durations of one or more of the segments.

13. A method according to claim 10, wherein the prosodic information comprises respective energy levels of the segments to be incorporated in the output speech signal, and wherein adjusting the feature vectors comprises altering one or more of the vector elements so as to adjust the energy levels of one or more of the segments.

14. A method according to claim 1, wherein processing the selected sequences comprises adjusting the vector elements so as to provide a smooth transition between the segments in the time domain signal.

15. A method according to claim 1, wherein the vector elements comprise Mel Frequency Cepstral Coefficients of the speech segments, determined based on the integrated spectral envelopes.

16. A method for speech synthesis, comprising:

receiving an input speech signal containing a set of speech segments;

estimating spectral envelopes of the input speech signal in a succession of time intervals during each of the speech segments;

integrating the spectral envelopes over a plurality of window functions in a frequency domain so as to determine elements of feature vectors corresponding to the speech segments; and reconstructing an output speech signal by concatenating the feature vectors corresponding to a sequence of the speech segments to form a series in a frequency domain, computing a series of complex line spectra of the output signal from the series of feature vectors, and transforming the complex line spectra to a time domain signal.

17. A method according to claim 16, wherein receiving the input speech signal comprises dividing the input speech signal into the segments and determining segment information comprising respective phonetic identifiers of the segments, and wherein reconstructing the output speech signal comprises selecting the segments whose feature vectors are to be concatenated responsive to the segment information determined with respect to the segments.

18. A method according to claim 17, wherein dividing the input speech signal into the segments comprises dividing the signal into lefemes, and wherein the phonetic identifiers comprise lefeme labels.

19. A method according to claim 17, wherein determining the segment information further comprises finding respective segment parameters including one or more of a duration, an energy level and a pitch of each of the segments, responsive to which parameters the segments are selected for use in reconstructing the output speech signal.

20. A method according to claim 19, wherein reconstructing the output speech signal comprises modifying the feature vectors of the selected segments so as to adjust the segment parameters of the segments in the output speech signal.

21. A method according to claim 16, and comprising determining respective degrees of voicing of the speech segments, and incorporating the degrees of voicing as elements of the feature vectors for use in reconstructing the output speech signal.

22. A method according to claim 16, wherein the window functions are non-zero only within different, respective spectral windows and have variable values over their respective windows, and wherein integrating the spectral envelopes comprises calculating products of the spectral envelopes with the window functions, and calculating integrals of the products over the respective windows of the window functions.

23. A method according claim 22, and comprising applying a mathematical transformation to the integrals in order to determine the elements of the feature vectors.

24. A method according to claim 23, wherein the frequency domain comprises a Mel frequency domain, and wherein applying the mathematical transformation comprises applying log and discrete cosine transform operations in order to determine Mel Frequency Cepstral Coefficients to be used as the elements of the feature vectors.

25. A device for speech synthesis, comprising:

a memory, arranged to hold a segment inventory comprising, for a plurality of speech segments, respective sequences of feature vectors having vector elements determined by estimating spectral envelopes of input speech signals corresponding to the speech segments in a succession of time intervals during each of the speech segments, and integrating the spectral envelopes over a plurality of window functions in a frequency domain; and a speech processor, arranged to receive phonetic and prosodic information indicative of an output speech signal to be generated, to select the sequences of feature vectors from the inventory responsive to the phonetic and prosodic information, to process the selected sequences of feature vectors so as to generate a concatenated output series of feature vectors in a frequency domain, and to compute a series of complex line spectra of the output signal from the series of the feature vectors and transform the complex line spectra to a time domain speech signal for output.

26. A device according to claim 25, wherein the segment inventory comprises segment information comprising respective phonetic identifiers of the segments, and wherein the processor is arranged to select the sequences of feature vectors by finding the segments in the inventory whose phonetic identifiers are close to the received phonetic information.

27. A device according to claim 26, wherein the segments comprise lefemes, and wherein the phonetic identifiers comprise lefeme labels.

28. A device according to claim 26, wherein the segment information further comprises one or more prosodic parameters with respect to each of the segments, and wherein the processor is arranged to select the sequences of feature vectors by finding the segments whose one or more prosodic parameters are close to the received prosodic information.

29. A device according to claim 28, wherein the one or more prosodic parameters are selected from a group of parameters consisting of a duration, an energy level and a pitch of each of the segments.

30. A device according to claim 25, wherein the feature vectors comprise auxiliary vector elements indicative of further features of the speech segments, in addition to the elements determined by integrating the spectral envelopes of the input speech signals.

31. A device according to claim 30, wherein the auxiliary vector elements comprise voicing vector elements indicative of a degree of voicing of frames of the corresponding speech segments, and wherein the processor is arranged to reconstruct the output speech signal with the degree of voicing indicated by the voicing vector elements.

32. A device according to claim 31, wherein the prosodic information comprises pitch values, and wherein the processor is arranged to adjust a frequency spectrum of the output speech signal responsive to the pitch values.

33. A device according to claim 25, wherein the processor is arranged to select the sequences of feature vectors by selecting candidate segments from the inventory, computing a cost function for each of the candidate segments responsive to the phonetic and prosodic information and to the feature vectors of the candidate segments, and selecting the segments so as to minimize the cost function.

34. A device according to claim 25, wherein the processor is arranged to adjust the feature vectors in the combined output series responsive to the prosodic information.

35. A device according to claim 34, wherein the prosodic information comprises respective durations of the segments to be incorporated in the output speech signal, and wherein the processor is arranged to adjust the feature vectors by removing one or more of the feature vectors from the selected sequences so as to shorten the durations of one or more of the segments.

36. A device according to claim 34, wherein the prosodic information comprises respective durations of the segments to be incorporated in the output speech signal, and wherein the processor is arranged to adjust the feature vectors by adding one or more further feature vectors to the selected sequences so as to lengthen the durations of one or more of the segments.

37. A device according to claim 34, wherein the prosodic information comprises respective energy levels of the segments to be incorporated in the output speech signal, and wherein the processor is arranged to adjust the energy levels of one or more of the segments by altering one or more of the vector elements.

38. A device according to claim 25, wherein the processor is arranged to adjust the vector elements so as to provide a smooth transition between the segments in the time domain signal.

39. A device according to claim 25, wherein the vector elements comprise Mel Frequency Cepstral Coefficients of the speech segments, determined based on the integrated spectral envelopes.

40. A device for speech synthesis, comprising:

a memory, arranged to hold a segment inventory determined by processing an input speech signal containing a set of speech segments so as to estimate spectral envelopes of the input speech signal in a succession of time intervals during each of the speech segments, and integrating the spectral envelopes over a plurality of window functions in a frequency domain so as to determine elements of feature vectors corresponding to the speech segments; and a speech processor, arranged to reconstruct an output speech signal by concatenating the feature vectors corresponding to a sequence of the speech segments to form a series in a frequency domain, computing a series of complex line spectra of the output signal from the series of feature vectors, and transforming the complex line spectra to a time domain signal.

41. A device according to claim 40, wherein the input speech signal is processed by dividing the input speech signal into the segments and determining segment information comprising respective phonetic identifiers of the segments, and wherein the processor is arranged to reconstruct the output speech signal by selecting the segments whose feature vectors are to be concatenated responsive to the segment information determined with respect to the segments.

42. A device according to claim 41, wherein the input speech signal is divided into lefemes, and the phonetic identifiers comprise lefeme labels.

43. A device according to claim 41, wherein the segment information further comprises respective segment parameters including one or more of a duration, an energy level and a pitch of each of the segments, responsive to which parameters the segments are selected by the processor for use in reconstructing the output speech signal.

44. A device according to claim 43, wherein the processor is arranged to modify the feature vectors of the selected segments so as to adjust the segment parameters of the segments in the output speech signal.

45. A device according to claim 40, wherein the feature vectors comprise respective degrees of voicing of the speech segments, for use by the processor in reconstructing the output speech signal.

46. A device according to claim 40, wherein the window functions are non-zero only within different, respective spectral windows and have variable values over their respective windows, and wherein the feature vector elements are determined by calculating products of the spectral envelopes with the window functions, and calculating integrals of the products over the respective windows of the window functions.

47. A device according claim 46, wherein a mathematical transformation is applied to the integrals in order to determine the elements of the feature vectors.

48. A device according to claim 46, wherein the frequency domain comprises a Mel frequency domain, and wherein the mathematical transformation comprises log and discrete cosine transform operations, which are applied so as to determine Mel Frequency Cepstral Coefficients to be used as the elements of the feature vectors.

49. A computer software product, comprising a computer-readable medium in which program instructions are stored, which instructions, when read by a computer, cause the computer to access a segment inventory comprising, for a plurality of speech segments, respective sequences of feature vectors having vector elements determined by estimating spectral envelopes of input speech signals corresponding to the speech segments in a succession of time intervals during each of the speech segments, and integrating the spectral envelopes over a plurality of window functions in a frequency domain, and in response to phonetic and prosodic information indicative of an output speech signal to be generated, cause the computer to select the sequences of feature vectors from the inventory responsive to the phonetic and prosodic information, to process the selected sequences of feature vectors so as to generate a concatenated output series of feature vectors in a frequency domain, and to compute a series of complex line spectra of the output signal from the series of the feature vectors and transform the complex line spectra to a time domain speech signal for output.

50. A product according to claim 49, wherein the segment inventory comprises segment information comprising respective phonetic identifiers of the segments, and wherein the instructions cause the computer to select the sequences of feature vectors by finding the segments in the inventory whose phonetic identifiers are close to the received phonetic information.

51. A product according to claim 50, wherein the segments comprise lefemes, and wherein the phonetic identifiers comprise lefeme labels.

52. A product according to claim 50, wherein the segment information further comprises one or more prosodic parameters with respect to each of the segments, and wherein the instructions cause the computer to select the sequences of feature vectors by finding the segments whose one or more prosodic parameters are close to the received prosodic information.

53. A product according to claim 52, wherein the one or more prosodic parameters are selected from a group of parameters consisting of a duration, an energy level and a pitch of each of the segments.

54. A product according to claim 52, wherein the feature vectors comprise auxiliary vector elements indicative of further features of the speech segments, in addition to the elements determined by integrating the spectral envelopes of the input speech signals.

55. A product according to claim 54, wherein the auxiliary vector elements comprise voicing vector elements indicative of a degree of voicing of frames of the corresponding speech segments, and wherein the instructions cause the computer to reconstruct the output speech signal with the degree of voicing indicated by the voicing vector elements.

56. A product according to claim 55, wherein the prosodic information comprises pitch values, and wherein the instructions cause the computer to adjust a frequency spectrum of the output speech signal responsive to the pitch values.

57. A product according to claim 49, wherein the instructions cause the computer to select the sequences of feature vectors by selecting candidate segments from the inventory, computing a cost function for each of the candidate segments responsive to the phonetic and prosodic information and to the feature vectors of the candidate segments, and selecting the segments so as to minimize the cost function.

58. A product according to claim 49, wherein the instructions cause the computer to adjust the feature vectors in the combined output series responsive to the prosodic information.

59. A product according to claim 58, wherein the prosodic information comprises respective durations of the segments to be incorporated in the output speech signal, and wherein the instructions cause the computer to adjust the feature vectors by removing one or more of the feature vectors from the selected sequences so as to shorten the durations of one or more of the segments.

60. A product according to claim 58, wherein the prosodic information comprises respective durations of the segments to be incorporated in the output speech signal, and wherein the instructions cause the computer to adjust the feature vectors by adding one or more further feature vectors to the selected sequences so as to lengthen the durations of one or more of the segments.

61. A product according to claim 58, wherein the prosodic information comprises respective energy levels of the segments to be incorporated in the output speech signal, and wherein the instructions cause the computer to adjust the energy levels of one or more of the segments by altering one or more of the vector elements.

62. A product according to claim 49, wherein the instructions cause the computer to adjust the vector elements so as to provide a smooth transition between the segments in the time domain signal.

63. A product according to claim 49, wherein the vector elements comprise Mel Frequency Cepstral Coefficients of the speech segments, determined based on the integrated spectral envelopes.

64. A computer software product, comprising a computer-readable medium in which a segment inventory is stored, the inventory having been determined by processing an input speech signal containing a set of speech segments so as to estimate spectral envelopes of the input speech signal in a succession of time intervals during each of the speech segments, and integrating the spectral envelopes over a plurality of window functions in a frequency domain so as to determine elements of feature vectors corresponding to the speech segments, so that a speech processor can reconstruct an output speech signal by concatenating the feature vectors corresponding to a sequence of the speech segments to form a series in a frequency domain, computing a series of complex line spectra of the output signal from the series of feature vectors, and transforming the complex line spectra to a time domain signal.

65. A product according to claim 64, wherein the input speech signal is processed by dividing the input speech signal into the segments and determining segment information comprising respective phonetic identifiers of the segments, and wherein to reconstruct the output speech signal, the processor selects the segments whose feature vectors are to be concatenated responsive to the segment information determined with respect to the segments.

66. A product according to claim 64, wherein the input speech signal is divided into lefemes, and the phonetic identifiers comprise lefeme labels.

67. A product according to claim 64, wherein the segment information further comprises respective segment parameters including one or more of a duration, an energy level and a pitch of each of the segments, responsive to which parameters the segments are selected by the computer for use in reconstructing the output speech signal.

68. A product according to claim 67, wherein to reconstruct the output speech signal, the instructions cause the computer to modify the feature vectors of the selected segments so as to adjust the durations and energy levels of the segments in the output speech signal.

69. A product according to claim 64, wherein the feature vectors comprise respective degrees of voicing of the speech segments, for use by the computer in reconstructing the output speech signal.

70. A product according to claim 64, wherein the window functions are non-zero only within different, respective spectral windows and have variable values over their respective windows, and wherein the feature vector elements are determined by calculating products of the spectral envelopes with the window functions, and calculating integrals of the products over the respective windows of the window functions.

71. A product according claim 70, wherein a mathematical transformation is applied to the integrals in order to determine the elements of the feature vectors.

72. A product according to claim 71, wherein the frequency domain comprises a Mel frequency domain, and wherein the mathematical transformation comprises log and discrete cosine transform operations, which are applied so as to determine Mel Frequency Cepstral Coefficients to be used as the elements of the feature vectors.

* * * * *